United States Patent [19]

Jackson

[11] Patent Number: 5,039,107

[45] Date of Patent: Aug. 13, 1991

[54] FOOTBALL BOARD GAME DIRECTED TO SIMULATING ATHLETIC COMPETITION

[76] Inventor: Aaron C. Jackson, 452 Rivers Ridge Cir., Newport News, Va. 23602

[21] Appl. No.: 474,540

[22] Filed: Feb. 2, 1990

[51] Int. Cl.[5] ..... A63F 3/00

[52] U.S. Cl. ..... 273/237; 273/247

[58] Field of Search ..... 273/236, 237, 244, 247, 273/277, 282, 288

[56] References Cited

U.S. PATENT DOCUMENTS

| | | | |
|---|---|---|---|
| 3,853,264 | 12/1974 | Hovorka | 273/247 X |
| 3,887,191 | 6/1975 | Lucas | 273/247 |
| 4,027,882 | 6/1977 | Rosenberg | 273/247 |
| 4,108,442 | 8/1978 | Bynam | 273/237 |
| 4,252,321 | 2/1981 | Hopwood | 273/247 |
| 4,346,899 | 8/1982 | Nuebling | 273/244 |
| 4,486,022 | 12/1984 | Dixon | 273/244 X |
| 4,706,959 | 11/1987 | Price | 273/247 |
| 4,759,549 | 7/1988 | Beckwith | 273/247 X |

*Primary Examiner*—Edward M. Coven
*Assistant Examiner*—William E. Stoll
*Attorney, Agent, or Firm*—Morton J. Rosenberg; David I. Klein

[57] ABSTRACT

A football game (10) is provided to be played by a plurality of users, having a game board (20) divided into a plurality of player regions (22, 24 and 26) and a status region (28). Each of the player regions and the status region having removably writable areas (30) for inscribing indicia with a marker (34) which is subsequently removable through the use of an eraser (36). Each of the playing areas (22, 24 and 26) includes a calculator mounting area (40) having a calculating device (44) releasably coupled thereto. The calculating devices (44) are utilized for accumulating scores, computing statistics, and may include a random number generator for initially establishing the hierarchical ranking of the football teams represented in the game.

20 Claims, 7 Drawing Sheets

FOOTBALL BOARD GAME DIRECTED TO SIMULATING ATHLETIC COMPETITION

BACKGROUND OF THE INVENTION

1. Field of the Invention

This invention directs itself to board games which simulate athletic competition between a plurality of teams and adapted to be played by a plurality of users. In particular, this invention directs itself to the simulation of a football playing season, wherein a plurality of teams compete to establish the number one ranked team. More in particular, this invention directs itself to a game having a game board member provided with a plurality of removably writable areas formed thereon, allowing indicia to be inscribed thereon and then subsequently easily removed. Still further, this invention directs itself to a game board member having a calculating device for each player removably coupled to a respective portion of the playing board member. Further, this invention directs itself to a game board member having raised card holding members for maintaining game cards a predetermined distance above the game board surface, allowing the cards to be easily handled by the users.

2. Prior Art

Board games simulating athletic competition between teams are well known in the art, however, board games which attempt to simulate an entire playing season are not known. Further, the known prior art does not provide game boards having raised card support areas for supporting game cards thereon and improving the ease by which the users can manipulate the cards resting thereon.

Still further, none of the games currently on the market include game card receptacles having both horizontally and vertically directed receiving chambers, wherein the horizontally directed chambers provide storage for the cards still in play and the vertically directed chambers provide storage for cards which are taken out of play and are not to be used during the remainder of the game.

SUMMARY OF THE INVENTION

A football board game adapted to be played by a plurality of users is provided. The football board games comprises a game board system for simulating the football games played between a plurality of football teams, and includes a game board member having an upper surface subdivided into (1) a plurality of player regions, and (2) a status region. The football board game also includes a first multiplicity of decks of score cards for each of the plurality of users, with each of the first decks of score cards corresponding to a different football team and having indicia on one side of each score card representing the football team's potential scoring points. The football board game further includes a receptacle system for receiving each of the user's first decks of score cards and being movably located adjacent the respective players regions of the board member. A calculating device is also provided for computing the football game scores responsive to a substantially random selection of the scoring points from the first decks of score cards. Each player is provided with a calculating device being releasably coupled to the board member in the respective player region.

DESCRIPTION OF THE PREFERRED EMBODIMENTS

Referring now to FIGS. 1–20, there is shown a board game directed to simulating athletic competition between a plurality of teams and adapted to be played by a plurality of users. The game provides for the specific purposes of enjoyment and amusement by those involved in playing the game. In overall concept, the board game simulates an athletic competitive season between a plurality of teams which would play against one another for determining a hierarchical ranking. Although this board game will be described as a simulation of a football season, and more in particular a college football season, the novel structure and inventive concepts may be equally applied to games simulating other athletic competitions between teams, such as basketball, lacrosse, soccer, hockey, baseball, and the like.

Figure 1:
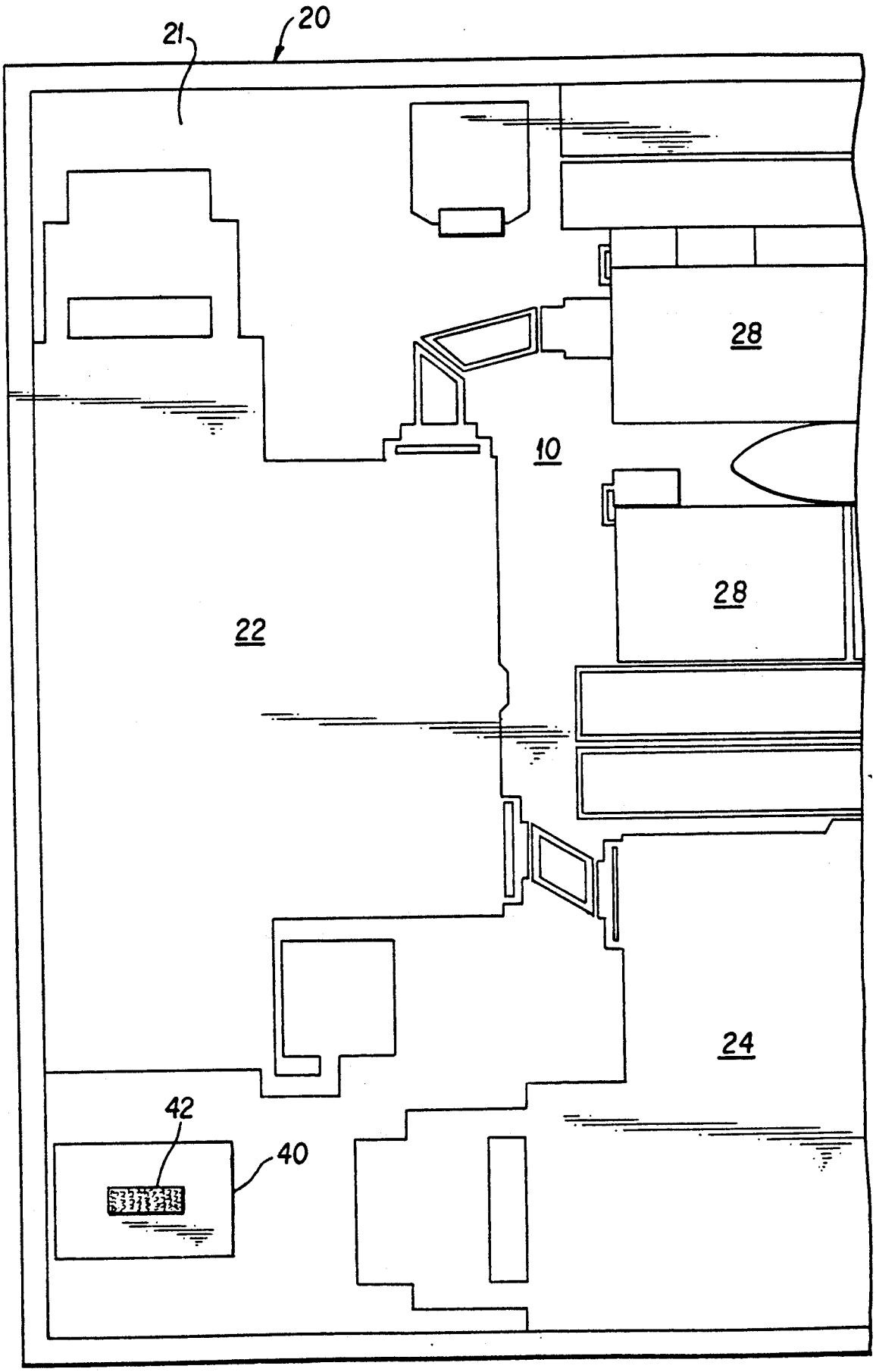
FIG. 1 is a partial plane view of one half of the game board.
Figure 2:
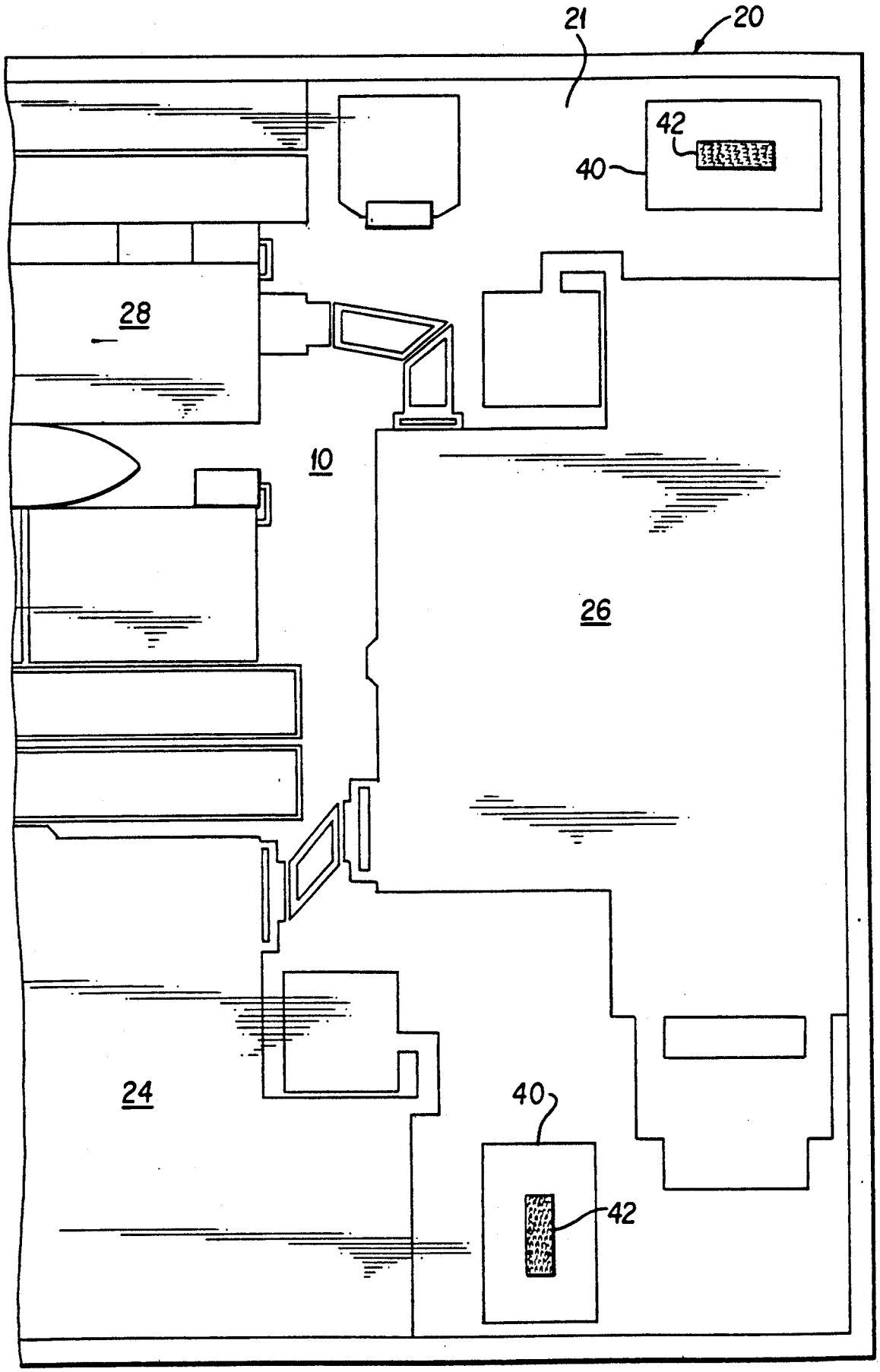
FIG. 2 is a partial plane view of a second half of the game board.

The board game 10 includes a game board 20, shown in FIGS. 1 and 2, having an upper surface 21 which is subdivided into a plurality of player regions 22, 24 and 26 and a status region 28, whose functions will be described in following paragraphs. Additionally, the upper surface 21 of game board 20 has additional areas 40 adapted for releasable coupling with a calculating device 44, shown in FIG. 11.

Figures 10, 11, 12, 13, 14, 15, 16:
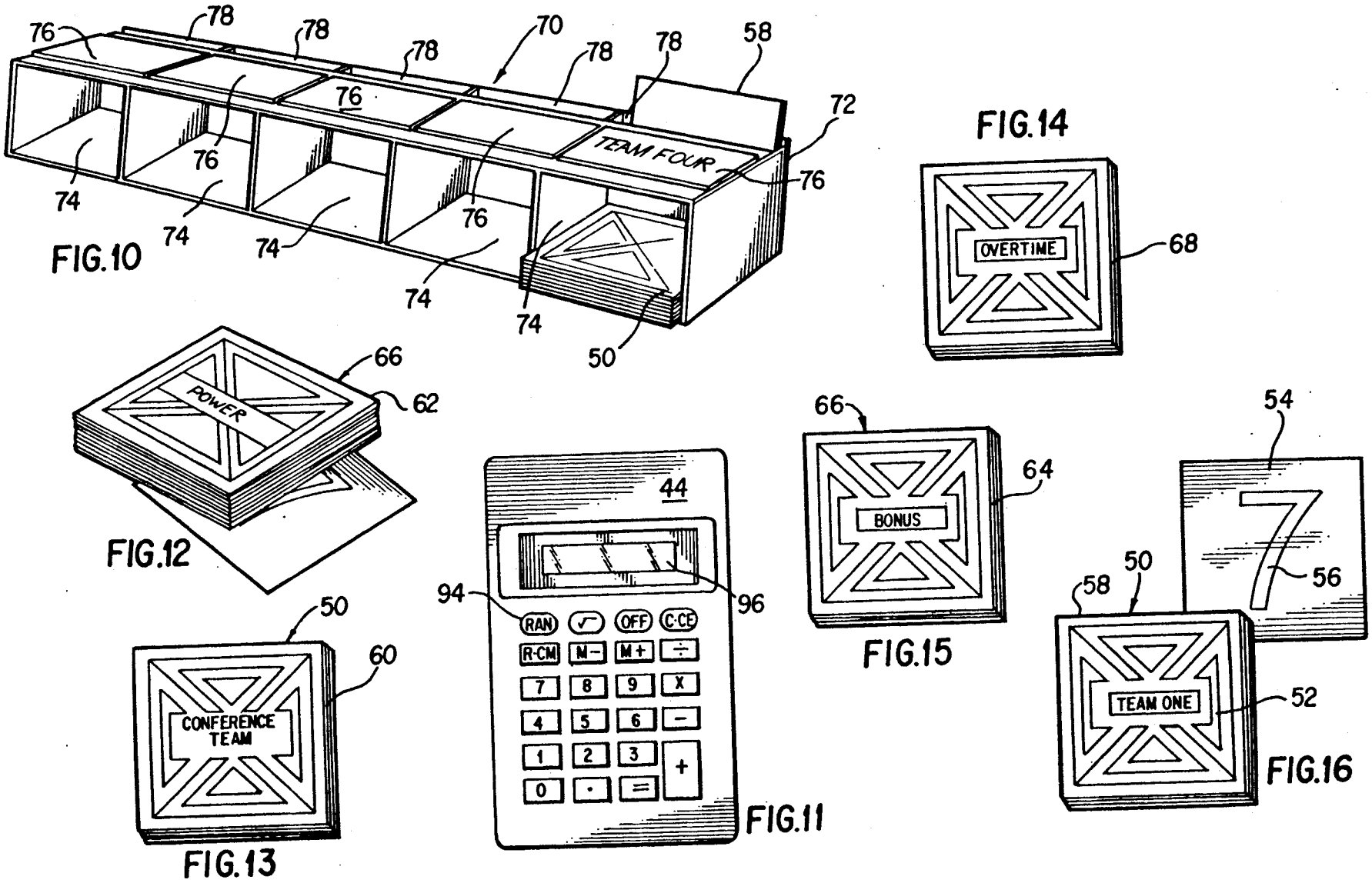
FIG. 10 is a perspective view of the receptacle system for the football game.
FIG. 11 is a plane view of a calculating device for use in the football game.
FIG. 12 is a perspective view of a deck of Power cards for the football game.
FIG. 13 is a perspective view of a deck of conference team cards for the football game.
FIG. 14 is a perspective view of a deck of overtime cards for the football game.
FIG. 15 is a perspective view of a deck of bonus cards for the football game.
FIG. 16 is a perspective view of a deck of team cards for the football game.

As shown in FIG. 11, the calculating device 44 may be an electronic calculator, the type well known in the art, or alternately may be any one of a plurality of mechanical or slide rule type calculating devices, not shown. The calculating device 44 is releasably secured to the calculator mounting area 40 disposed on the upper surface 21 of the game board 20 by means of a hook and loop type fastening system. One portion of the hook and loop type fastening system 42 is fixedly coupled to the upper surface 21 of game board 20, while the other portion (not shown) is fixedly coupled to the underside portion of the calculating device 44. Thus, the calculator 44 may be retained within the mounting area 40, or easily removed and conveniently held by the user. Obviously other means of coupling between calculating device 44 and mounting area 40 may be substituted without departing from the inventive concept, as described herein.

Figure 3:
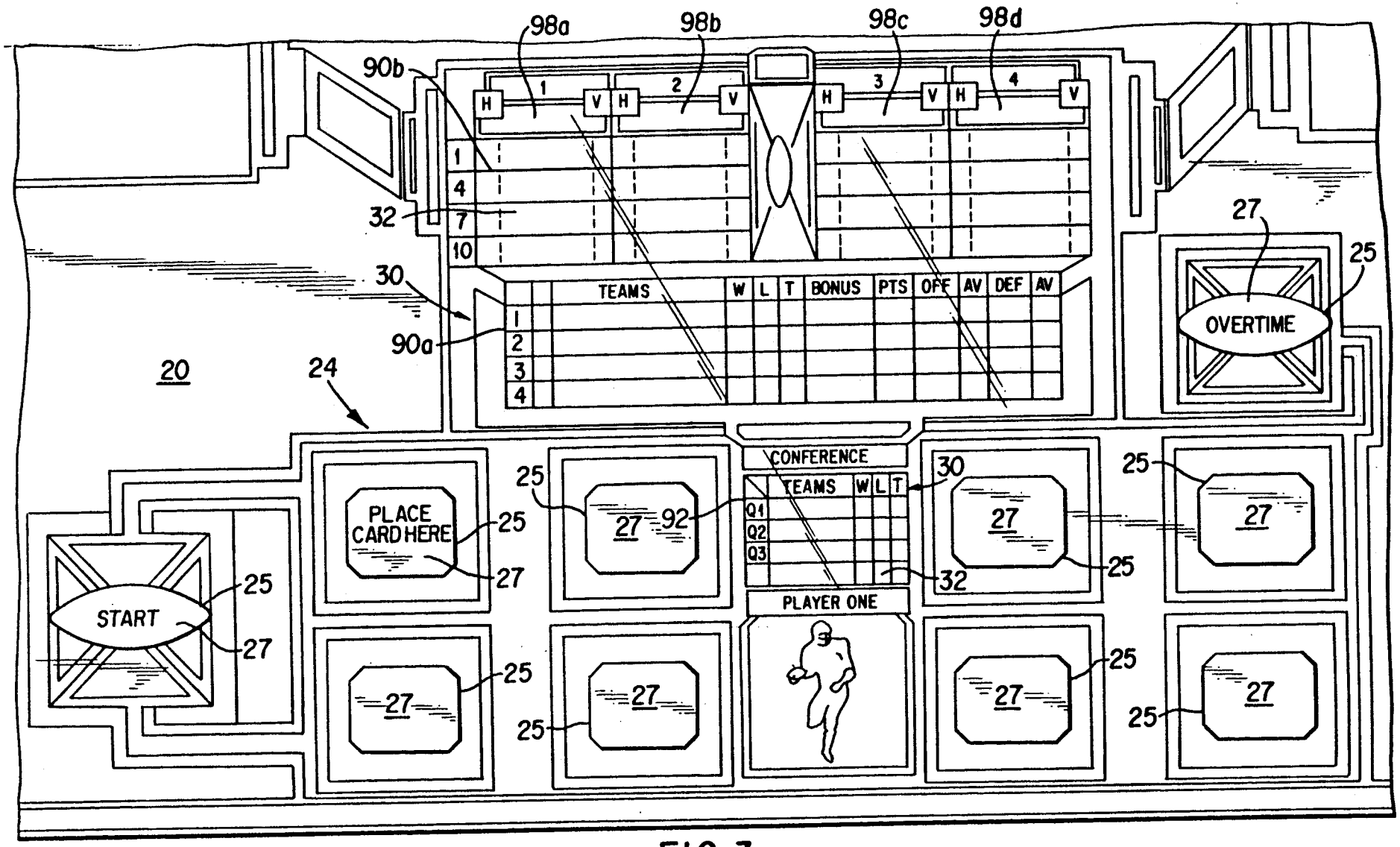
FIG. 3 is a plane view of a player region of the game board.
Figure 18:
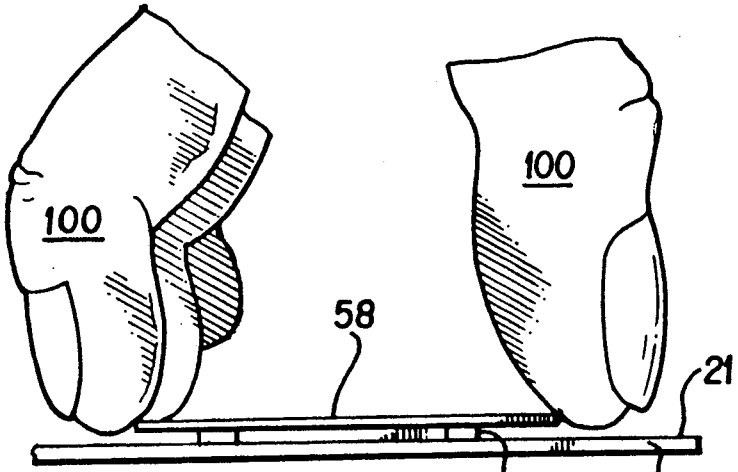
FIG. 18 is an enlarged detail of the card holding portion of the game board.

Referring to FIG. 3, there is shown the player region 24 of game board 20. The player region 24 includes a plurality of card supports 25 upon which are placed various cards during the play of the game. As shown in FIG. 18, the card supports 25 support the card 58 a predetermined distance above the upper surface 21 of the game board 20, and each support 25 has at least a length or a width dimension which is less than the card 58 for allowing the fingers 100 of the player to more easily grasp the card 58. Typically, the card supports 25 have both length and width dimensions which are smaller than the corresponding dimensions of the card 58.

Figure 19:
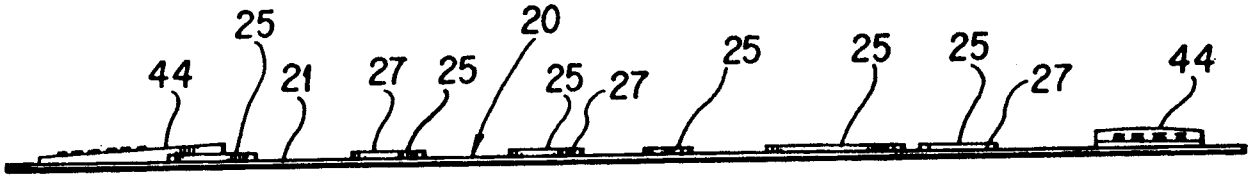
FIG. 19 is an end view of the game board showing the raised card holding areas and calculating devices; and, FIG. 20 is an enlarged cutaway view of one of the removably writable areas of the game board.
Figure 20:
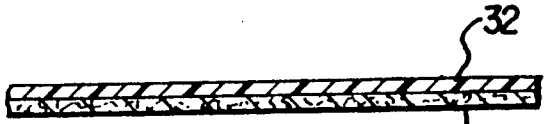
Figure 17:
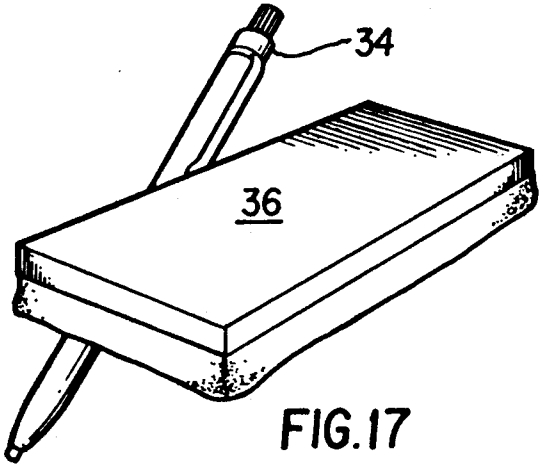
FIG. 17 is a perspective view of the marker and eraser for the football game

Player region 24 further includes a plurality of removably writable areas 30 onto which is written indicia representing team names, and team statistics, for example. As shown in FIG. 20, the removably writable areas 30 are provided with a plastic laminate or coating 32 overlaying the areas 30 of game board 20, such that a marker 34, shown in FIG. 17, may be utilized to inscribe the necessary indicia on areas 30, which may be then subsequently erased utilizing the eraser 36. Such erasable marking systems using either felt-tip type marking devices or grease pencil type devices are well known in the art, as are the pad-type erasing devices, shown in FIG. 17, for use with the respective markers. The end view of game board 20, shown in FIG. 19, shows the non-planar structure thereof. Each of the card supports 25 having an upper surface 27 vertically displaced a predetermined distance from upper surface 21 of game board 20.

The particular arrangement of card supports 25 and removable writable areas 30 of player region 24 are duplicated in each of the other player regions 22 and 26 and thus it should be understood that the discussion of the details of player region 24 apply also to player regions 22 and 26.

Figure 4:
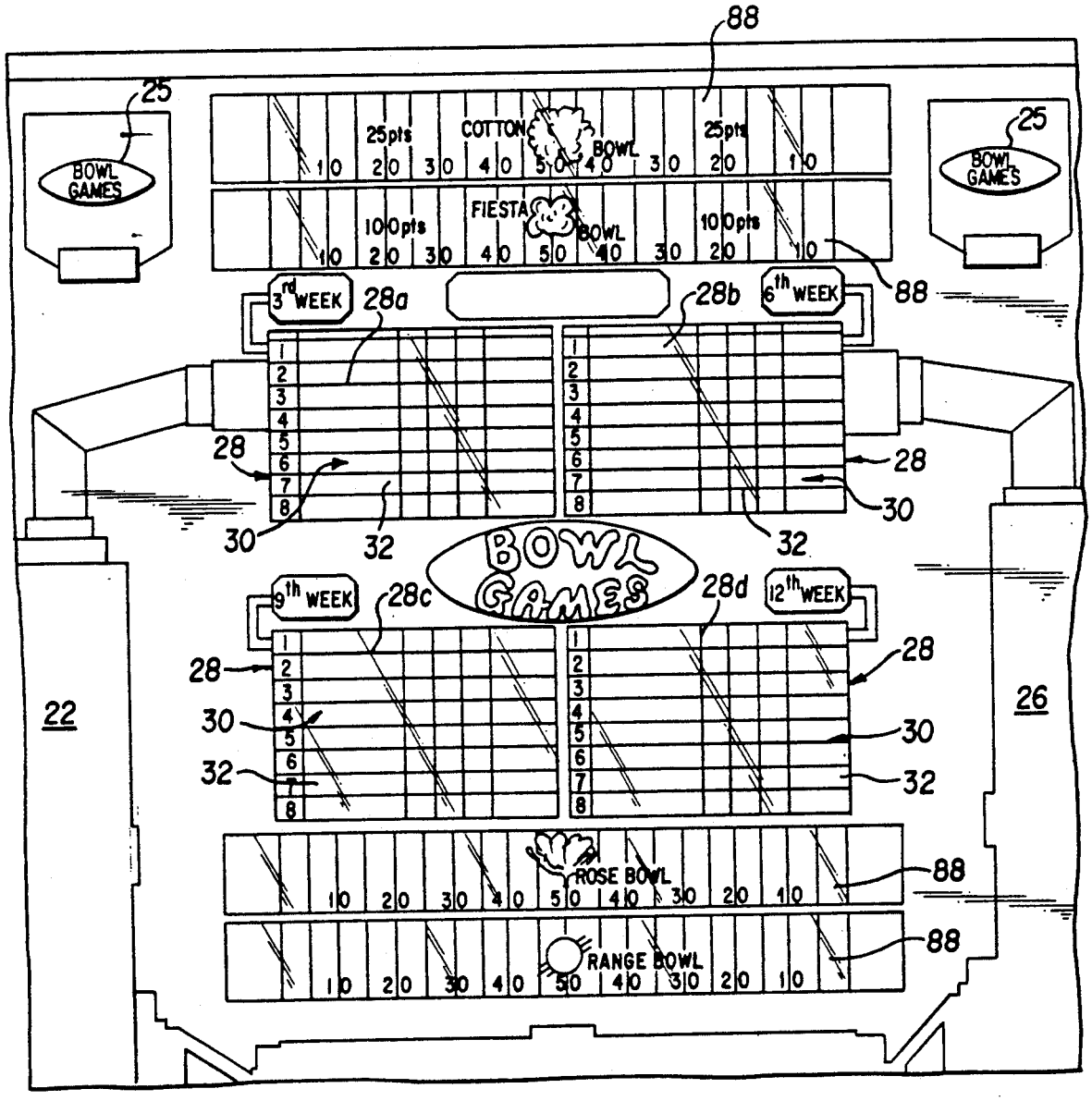
FIG. 4 is a plane view of the status region of the game board.
Figure 9:
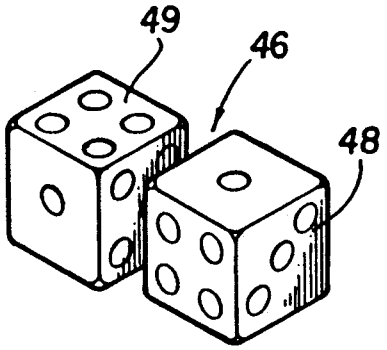
FIG. 9 is a perspective view of a pair of dice.

Referring to FIG. 4, there is shown the status region 28 of game board 20. Although not important to the inventive concept, status region 28 of game board 20 is disposed between the player regions 22 and 26 of game board 20. Status region 28 includes a plurality of removably writable areas 30, each having an overlaying plastic laminate or coating 32, as previously described for the player regions 22, 24 and 26. Additionally, status region 28 includes a plurality of bowl game indicating areas 88 being of sufficient size to receive pairs of bowl game place cards 82, shown in FIG. 7, each having indicia removably written thereon indicating the names of the teams which have been ranked sufficiently high to play in the final playoff games, the bowl games. Each bowl game place card 82 is provided with a removably writable area 30 upon which indicia are inscribed using a marker 34.

Figure 5:
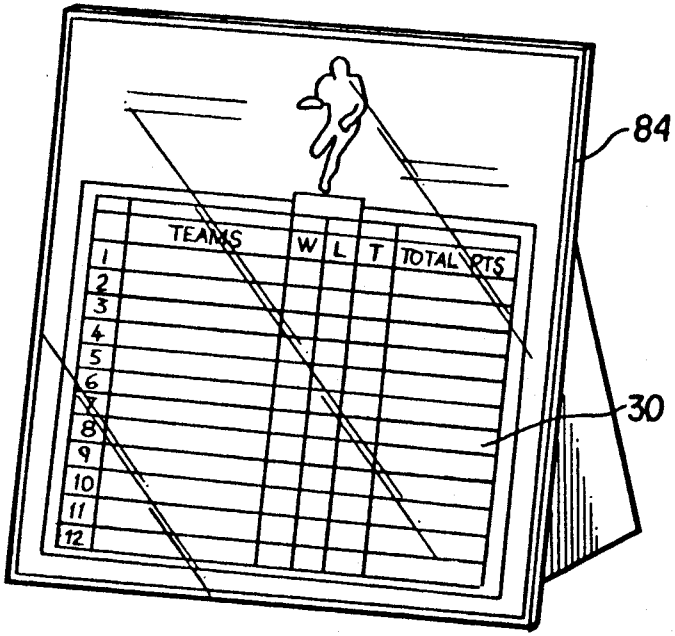
FIG. 5 is a perspective view of a first framed status card.

Additional accessories utilized for playing board game 10 include a first framed status card 84, shown in FIG. 5, upon which each player's selected teams are ranked, for purposes of starting the play of the game. First framed status card 84 includes a removably writable area 30 having a construction substantially the same as the removable writable areas 30 of game board 20. Thus, each player's selected teams may be removably inscribed on area 30 and then subsequently erased to allow for future play of board game 10. Board game 10 further includes a second framed status card 86 having a removably writable area 30, as is similarly provided on first framed status card 84. Second framed status card 86, shown in FIG. 6, includes indicia areas, as similarly provided on first framed status card 84, wherein the names of the teams which have been ranked sufficiently high to play in the final competition, the bowl games, may be removably inscribed. Removably writable area 30 of second framed status card 86 further includes indicia areas upon which each of the team's statistics and the final point outcome of the bowl games can be tabulated. Obviously, the statistical values and accumulated points are easily tabulated using the calculating devices 44 releasably coupled to each of the player regions 22, 24 and 26 of game board 20.

Each player is provided with a movable card receptacle 70 which may be disposed adjacent each respective player region of game board 20, for receiving at least one deck of score cards 50 therein. Receptacle system 70 comprises a card holder 72 having at least one horizontally directed receiving chamber and at least one corresponding vertically directed receiving chamber, whose functions will be described in following paragraphs. In one working embodiment, card holder 72 includes five horizontally directed receiving chambers 74, each receiving a respective first deck of score cards 50, four decks of score cards each being identified by sequential team numbers, as for example Team 1–Team 4 and the fifth being identified differently. Each player having the same plurality of first decks of score cards 50, which include four decks of team cards 58, shown in FIG. 16, representing ranked teams, and one deck each of conference team cards 60, shown in FIG. 13, representing unranked teams. Each of the score cards of first decks of score cards 50 are provided with a first side upon which the card is labeled as a conference team card 60 or a ranked team card 58, having indicia indicating that the card represents a conference team or one of the teams 1–4. On the opposing second side 54 of each of cards 58 and 60 there is provided indicia 56, representing the scored points for a particular period of play. For a game simulating football, the period of play would be a quarter. Thus, during that portion of the play of the game representing a football game, four cards would be drawn, as will be described in following paragraphs, to represent the total points scored during each of the four quarters of the game.

In a typical game, where there are initially twelve ranked teams and three players, each player controls four teams, the names of which are each entered in a first portion of a schedule box **90*a* located within one of the removably writable areas 30 in each of the player regions 22, 24 and 26, as shown in FIG. 3. Each player arbitrarily chooses the hierarchical sequence of his four teams and enters their name adjacent the permanently marked numbers 1–4 in the schedule box 90***a*.

Figure 8:
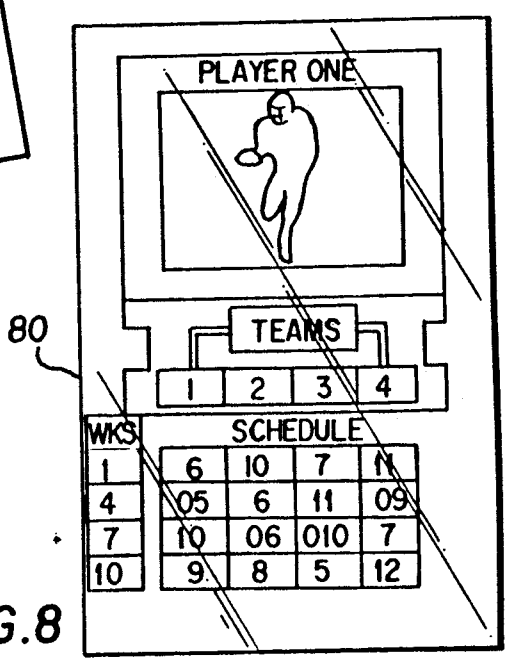
FIG. 8 is a plane view of player schedule card.
Figure 6:
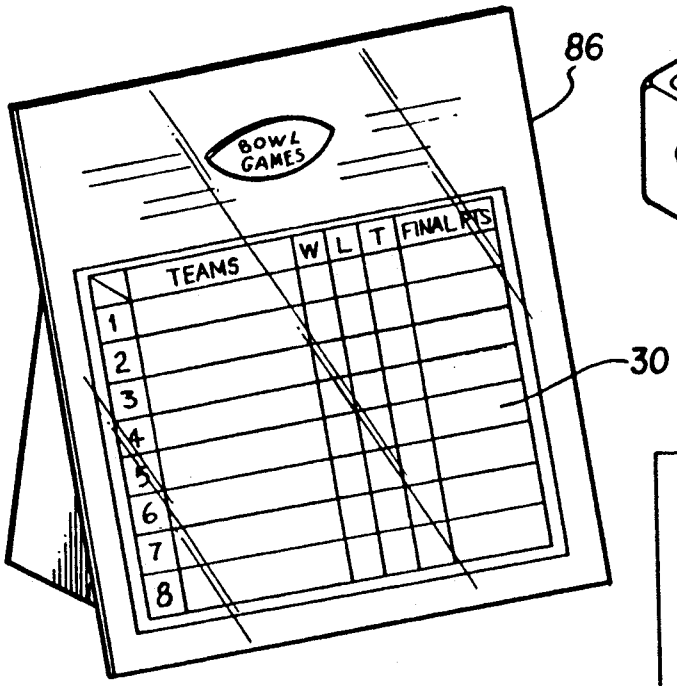
FIG. 6 is a perspective view of a second framed status card.
Figure 7:
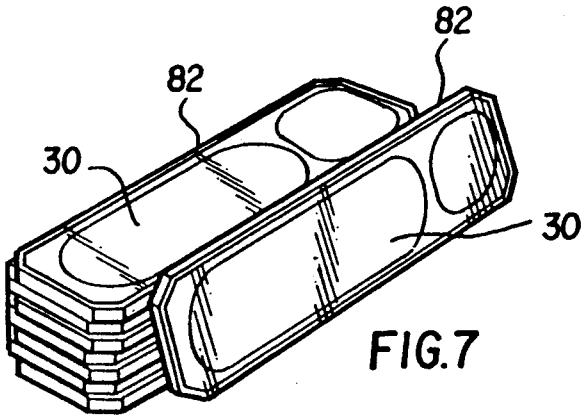
FIG. 7 is a perspective view of a bowl game place card.

Each player receives a respective schedule card 80, shown in FIG. 8, which will be used for scheduling the play of games between opponents. On the opposing side of schedule card 80, not shown, there may be provided a listing of football team names from which a player may choose, thereby allowing a player unfamiliar with the teams competing in the sport to readily select team names. Obviously, a player would be free to choose fictitious names, if he so desired. Each player may then select the names cf four other teams, to represent the conference teams, the unranked teams, and those names are entered in the conference team schedule box 92, located within a respective removably writable area 30, having a plastic laminate film or coating thereon.

Having selected the team names, the twelve teams must then be ranked. This is done initially by using some means of chance. Each player is provided with a means for selection of a substantially random number 46, which may take the form of a first die 48 and a second die 49, shown in FIG. 9. Other means for selecting a substantially random number may be substituted for the pair of dice 46 that each player utilizes. As an example, referring to FIG. 11, the electronic calculators 44 that each player utilizes may include a random number generator for displaying a simulated random number on the calculator display 96 responsive to operation of the appropriate keyboard key 94.

The player obtaining the highest substantially random number enters the name of the team identified as his number one team on the first framed status card 84 as the highest ranked team, and each of the other players likewise enter their number one teams in the second and third rankings, based upon the hierarchical ranking of their respective random number selections. This procedure is repeated until all twelve teams have been entered on the first framed status card 84 in hierarchical order.

Each player then prepares his schedule for each of his four teams. Using the schedule card 80 each player identifies the opponent teams for play against his four teams, and enters the schedule in the second portion 90*b* of schedule box 90. Across the top portion of schedule box 90*b* there is provided team schedule spaces 98*a*–98*d* in which the names of the respective players' four teams are inscribed with the marker 34. Above the respective spaces 98*a*–98*d* there is provided permanent indicia indicating sequentially four identifying digits, for Player #1 the digits are 1–4, for Player #2 they are 5–8, and for Player #3 they are 9–12. On Player #1's schedule card, shown in FIG. 8, Player #1's first team is first scheduled to play Team Six, which is identified in the schedule box 90*b* of Player #2. Thus, Player #1's first team would first play Player #2's second team. Each of the other players having their own respective schedule cards 80 would likewise identify which of the other player's teams they are first scheduled to play. In this manner a playing season simulating twelve weeks of play is scheduled. In addition to the scheduling of the twelve ranked teams there are provided schedule dates for which teams may play unranked, conference teams. These teams are identified on the schedule card and the playing board by a "0" preceding the sequential team number. The conference team schedule box 92 located within each of the player regions 22, 24 and 26 are sequentially identified by indicia, Player #1 having indications 01–04, Player #2 having indicia indications of 05–08, and Player #3 having indications of 09–012. Thus, as shown in FIG. 8, Player #1's number one team will play Player #2's conference team 05 in the fourth simulated week of the season.

Having completed the scheduling for each player's teams, the players remove the appropriate deck of team cards 58 from the horizontally directed receiving chambers 74 of their respective card holders 72, placing the deck of cards on the card support 25 having permanent indicia indicated as "Start". Thus based on the exemplary schedule, Player #1 places the team card deck 58 being identified as Team One on the card support 25 labeled "Start", disposed in Player #1's player region 24. Player #2 removes the team cards 58 identified with the label Team Two from the respective horizontally directed receiving chamber 74 of Player #2's respective card holder 72 and locates those cards on the appropriate starting card holder 25 in his playing area. If the football game to be simulated were between Player #1s first team and the conference team of Player #2, Player #2 would remove the deck of conference team cards 60 from their respective horizontally directed receiving chamber 74, placing them on the starting card holder.

Each player then distributes four cards to each of four respective card holders 25, each representing a respective playing period of the game being simulated. Thus for football one card holder is provided for each quarter of the simulated football game. The means of distributing the four cards, in the exemplary embodiment, may be by dealing each card sequentially from a shuffled deck of team cards, randomly selecting the four cards from the deck, or selecting the cards by a separation of the deck by "cutting the cards" into four portions. The cards distributed to the four respective card supports 25 are turned over to their respective second sides 54 to reveal the indicia thereon, representing the points scored during the playing periods. Each player then totals his points to determine the outcome of the simulated game. If a tie results, then each player draws a card from their own respective deck of score cards 68, shown in FIG. 14, disposed on a card support 25 having the indicia "Overtime" permanently inscribed thereon. As in the actual football game, it is the overtime points which determines the winner for the particular game being simulated.

Each of the decks of team cards 58 and 60 are identical for each respective player. However, the decks of team cards 58 being identified for each of the sequentially numbered teams do vary in their respective statistical distribution of scoring points. Thus, the Team One cards 58 will have less scoring point cards having numerical values of 21 and 24 scoring points, for example. Whereas the team cards 58 representing Team Four may have double the number of cards having a score representing 0 points and far less cards representing higher scores. Likewise, the conference team cards 60 have indicia representing a numerical score distribution which is lower than that of the team cards 58.

The point distribution for each of the decks of team cards 58 may be altered during the course of the game through the use of one of the second decks of score cards 66. The winner of the simulated game between two teams has the option of exchanging each of the exposed score cards for a respective score card identified as a Power card 62, shown in FIG. 12. The Power cards 62 have indicia representing a higher range of point values, although some point values overlap those contained within the team card decks 58. Thus a player may take a chance to increase the numerical distribution of his team cards by replacing those played with a random selection from the Power card deck 62.

If a winning player elects to substitute Power cards for his team cards played he places the team cards which are to be substituted within the respective vertically directed receiving chamber 78 located behind the respective horizontally directed receiving chamber 74 of the card holder 72, the respective horizontally and vertically directed chambers 74 and 78 being identified by a respective nameplate 76 having the team number indicia permanently inscribed thereon, as shown in FIG. 10. The Power cards 62 randomly selected to replace the team cards now disposed within the respective vertically directed receiving chamber 78 are mixed with the other team cards for subsequent play. This sequence of play provides a means by which teams become more powerful. Each time games are won an opportunity is provided for altering the point distribution within the respective deck of team cards 58.

Subsequent to each of the players completing simulated games for each of their respective teams, such completes a simulated three weeks of the playing season. At this point, the standings between each of the twelve teams may be recomputed. Each player computes the total points scored by each of his teams for each of the respective games played. The number one ranked team being the team which has scored the most total points for the games played. The names of the top eight teams are entered sequentially in the first status area 28*a* of status region 28. This is repeated at the end of the sixth simulated week with the ranking being placed in the status area 28*b*, after the ninth simulated week in status area 28*c* and after the twelfth simulated week in status area 28*d*. Each of the status areas 28*a*–28*d* having a plastic laminate or coating 32 thereon to define a respective removably writable area 30.

The second decks of score cards 66 also include a deck of bonus cards 64, shown in FIG. 15, having indicia representing a scoring point value of either 10 or 20, substantially randomly distributed throughout the deck. Players having one of the top three ranked teams may select cards from the bonus deck 64 to add to the deck of team cards 58, thereby further strengthening the scoring potential of that simulated team.

The establishment of the top three teams is done after a predetermined number of simulated weeks of play, such as at the end of each simulated week or alternately after each simulated quarter of the season, a simulated three weeks. Each of the top three teams may obtain two bonus cards to represent the top three spots for that week.

At the end of the twelfth week of simulated play, the top eight ranked teams are recorded on the removably writable area 30 of the second framed status card 86 for preparation of the final play of simulated games, the bowl games. The player whose team is ranked number one first chooses which of the bowl games he wishes his team compete in, each of the bowl games having a respective point value which is added to the winner's total point accumulation. The number two ranked team then makes its choice of bowl games provided that there is an opening for a team in one of the bowl games. The player having the number three ranked team is the next to choose which bowl game his team is to compete in the same manner.

The bowl game selection process is continued until all four bowl games, depicted in areas 88 of game board 20, have been scheduled. To indicate these selections, each player inscribes their team name on the removable writable area 30 of the bowl game place card 82 and places the card in the area 88 of game board 20. The bowl games are played in the same manner as previously described for the simulated football games, wherein the respective team cards 58, now enhanced with Power cards 62 and bonus cards 64 are utilized to establish the game scores.

In addition to the scores thus established, the winner of each bowl game receives a point value bonus which is predetermined for each of the respective bowl games. For instance, a team winning in the Fiesta Bowl may be awarded 100 extra points whereas the team winning in the Cotton Bowl would receive only 25 additional points.

Optionally, the game may be enhanced by placing wagers on the outcome of each of the simulated games played, each player would start out with a predetermined sum which may be wagered openly, or discreetly. Such discreet wagering can be done by entering the amount to be wagered in the memory function of calculator 44, followed by subsequent recalling of the wager once the simulated game has been completed. Using the calculators 44 the simulated wagering funds can be maintained electronically, thus avoiding the need for supplying play money as a game accessory.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A football board game adapted to be played by a plurality of users, comprising:

a. game board means for simulating football games played between a plurality of football teams, said game board means including a board member having an upper surface subdivided into (1) a plurality of player regions, and (2) a status region;

b. a first multiplicity of decks of score cards for each of said plurality of users; each of said first decks of score cards corresponding to a different football team and having indicia on one side of each score card of said deck representing said football teams potential scoring points;

c. receptacle means for receiving each of said users first decks of score cards and being movably located adjacent said player regions of said board member; and, d. calculator means for computing football game scores responsive to a substantially random selection of said scoring points from said first decks of said score cards, said calculator means being releasably coupled to said board member.

2. The football board game as recited in claim 1 where said game board means includes means for removably writing indicia on said board member.

3. The football board game as recited in claim 2 where said removable writing means includes a plastic laminate overlaying predetermined areas of said upper surface of said board member within each of said plurality of player regions and said status region of said board member.

4. The football board game as recited in claim 3 where said removable writing means further includes marking means for inscribing indicia on said plastic laminate.

5. The football board game as recited in claim 4 where said removable writing means includes means for erasing said indicia inscribed by said marking means.

6. The football board game as recited in claim 1 where said receptacle means includes a plurality of card holding members, each of said plurality of card holding members corresponding to a respective one of said plurality of users and having at least one substantially horizontally directed receiving chamber for receipt of at least one of said first decks of score cards.

7. The football board game as recited in claim 6 where each of said plurality of card holding members has at least one substantially vertically directed receiving chamber for receiving at least one score card of said at least one deck of score cards.

8. The football board game as recited in claim 1 where said calculator means includes a plurality of electronic calculators, each of said plurality of electronic calculators corresponding to a respective one of said plurality of users and being releasably coupled to a respective one of said player regions of said board member.

9. The football board game as recited in claim 8 where each of said electronic calculators are releasably coupled to said board member by a hook and loop type fastening system.

10. The football board game as recited in claim 1 where said scoring points determined by said first decks of score cards are established by a predetermined point distribution for each of said first decks of score cards.

11. The football board game as recited in claim 10 where said game further comprises a second multiplicity of decks of score cards wherein each score card of said second decks has indicia on one side thereof representing additional scoring points for altering said predetermined point distribution of said first decks of score cards.

12. The football board game as recited in claim 11 where said game board means further includes card supporting means for supporting at least a portion of any of said first and second decks of score cards a predetermined distance above said upper surface of said board member.

13. The football board game as recited in claim 12 where said card supporting means includes a plurality of spacer members fixedly coupled to said upper surface of said board member, each of said plurality of spacer members having a predetermined height.

14. The football board game as recited in claim 13 where each of said spacer members have both a length and a width dimension smaller than a corresponding length and width dimension of said score cards to facilitate removing of any of said score cards placed thereon.

15. The football board game as recited in claim 1 including a first frame member having a surface adapted for removably writing thereon, said surface of said first frame member having indicated spaces for recording the names of football teams, their ranking, and their game statistics.

16. The football board game as recited in claim 15 including a second frame member having a surface adapted for removably writing thereon, said surface of said second frame member having indicated spaces for recording the names of football teams to play in a final round and the resulting scores therefrom.

17. The football board game as recited in claim 1 including means of chance for establishing an initial relative ranking between said plurality of football teams.

18. The football board game as recited in claim 1 including scheduling means for establishing a predetermined sequence by which said plurality of football teams are matched against one another.

19. A board game directed to athletic competition between a plurality of teams adapted to be played by a plurality of users, comprising:

a plurality of score cards having indicia on one side of each of said score cards representing at least one of said teams potential scoring points, each of said plurality of said score cards having both a predetermined length and width dimension; and, game board means for simulating athletic games played between said plurality of teams, said game board means including:

a. a board member having an upper surface subdivided into (1) a plurality of player regions, and (2) a status region; and, b. at least one card support member having an upper substantially planar surface disposed on said board member, said card support member having (1) a predetermined height dimension, and (2) both a length and a width dimension smaller than said length and width dimensions of each of said score cards, whereby removal of any of said score cards placed on said upper surface is facilitated.

20. The board game as recited in claim 19 including receptacle means for receiving at least a portion of said plurality of said score cards therein, said receptacle means including:

a. a plurality of first card receiving chambers being substantially horizontally directed, wherein each of said plurality of first card receiving chambers is adapted for holding a portion of said plurality of said score cards corresponding to one of said plurality of said teams; and, b. a plurality of second card receiving chambers being substantially vertically directed, wherein each of said plurality of second card receiving chambers is adapted for holding at least one score card removed from a respective one of said plurality of said first card receiving chambers.

* * * * *